US005282628A

United States Patent [19]

Komori et al.

[11] Patent Number: 5,282,628

[45] Date of Patent: Feb. 1, 1994

[54] AUTOMATIC GOLF BALL DISPENSER AND TEEING APPARATUS

[75] Inventors: Yutaka Komori; Shuichi Matsushita, both of Tokyo, Japan

[73] Assignee: Taito Corporation, Tokyo, Japan

[21] Appl. No.: 765,914

[22] Filed: Sep. 25, 1991

Related U.S. Application Data

[62] Division of Ser. No. 618,676, Nov. 6, 1990, Pat. No. 5,096,200.

[51] Int. Cl.[5] ..... A63B 57/00

[52] U.S. Cl. ..... 273/201

[58] Field of Search ..... 273/201, 33, 207, 209

[56] References Cited

U.S. PATENT DOCUMENTS

| | | | |
|---|---|---|---|
| 2,071,356 | 2/1937 | Pagett | 273/201 |
| 2,171,299 | 8/1939 | Beckett | 273/201 |
| 2,285,342 | 6/1942 | MacLellan | 273/201 |
| 2,675,237 | 4/1954 | Willcox | 273/201 |
| 3,003,771 | 10/1961 | Jones | 273/201 |
| 3,756,606 | 9/1973 | Land | 273/201 |
| 3,758,118 | 9/1973 | Willcox | 273/201 |
| 3,966,213 | 6/1976 | Bradley | 273/201 |
| 4,141,558 | 2/1979 | Hoffman | 273/201 |
| 4,177,996 | 12/1979 | Chang | 273/201 |
| 4,391,446 | 7/1983 | Eberle | 273/201 |
| 4,441,717 | 4/1984 | Willcox | 273/201 |

FOREIGN PATENT DOCUMENTS

| | | | |
|---|---|---|---|
| 1167077 | 5/1984 | Canada | 273/201 |

*Primary Examiner*—Theatrice Brown

*Attorney, Agent, or Firm*—Thomas R. Morrison

[57] ABSTRACT

An automatic golf ball dispenser dispenses golf balls to a tee for driving or directly to a mat for iron shots. The dispenser includes a breakaway captive setting arm that sustains minimal damage when hit by a club. The dispenser also includes a series of baffles and means for rotating stored golf balls to prevent clogging. A stopper retards balls in a supply chute while one ball is being teed, and while a setting arm is being returned to a ball-receiving position. This avoids interference with setting arm movement by the supply of balls. In addition, an automatic countdown sequence regulates the number of balls dispensed in accordance with a card reader that checks prepaid user cards.

12 Claims, 20 Drawing Sheets

AUTOMATIC GOLF BALL DISPENSER AND TEEING APPARATUS

This application is a division of Ser. No. 07/618,676, filed on Nov. 6, 1990 U.S. Pat. No. 5,096,200.

BACKGROUND OF THE INVENTION

The present invention relates to automatic ball dispensers and more particularly to golf ball dispensers that automatically position dispensed golf balls on a tee.

The use of automatic golf ball dispensers is well known, however, conventional dispensers have a number of disadvantages. Among these disadvantages is the tendency of feed paths to clog as stored balls press against each other, especially when the dispenser is fully loaded. Conventional dispensers are also subject to major damage when a user accidentally hits a ball positioning arm with a golf club before it is moved away from the tee. Another disadvantage of a conventional dispenser is that it cannot dispense golf balls to a mat for practice with an iron, but can only position golf balls on a tee.

OBJECTS AND SUMMARY OF THE INVENTION

Accordingly, it is an object of the invention to provide an automatic golf ball dispenser that overcomes the drawbacks of the prior art.

It is a further object of the invention to provide a golf ball dispenser that is not subject to clogging, regardless of the number of golf balls loaded into it.

It is a still further object of the invention to provide a golf ball dispenser that compensates for wear and provides extended operation with minimal operating failures.

It is a still further object of the invention to provide a golf ball dispenser that is not seriously damaged when a ball positioning arm of the dispenser is hit with a club during a practice swing.

It is a still further object of the invention to provide a dispenser that can, in addition to setting up golf balls on a tee, dispense a plurality of golf balls to a mat for practice with golf irons.

Briefly stated, the present invention provides an automatic golf ball dispenser that dispenses golf balls to a tee for driving or directly to a mat for iron shots. The dispenser includes a breakaway captive setting arm that sustains minimal damage when hit by a club. The dispenser also includes a series of baffles and means for rotating stored golf balls to prevent clogging. A stopper retards balls in a supply chute while one ball is being teed, and while a setting arm is being returned to a ball-receiving position. This avoids interference with setting arm movement by the supply of balls. In addition, an automatic countdown sequence regulates the number of balls dispensed in accordance with a card reader that checks prepaid user cards.

According to an embodiment of the invention, there is provided an automatic golf-ball supplying device comprising: storage means for storing a plurality of golf balls, a ball chute, a set arm, means for lining up golf balls from the storage means on the ball chute, means for swinging the ball chute in a vertical direction between first and second angles, the first angle being effective for permitting a ball to move onto the set arm, the second angle being effective for preventing a ball from moving toward the set arm, the set arm including a ball-receiving end and a ball-supplying side, means for rotating the set arm between a home position and a tee position, mixing means for mixing balls in the stocker unit, and means for synchronizing the mixing means with a swing of the ball chute.

According to a feature of the invention, there is provided an automatic golf-ball supplying device comprising: means for storing a plurality of golf balls, a ball chute, means for swinging the ball chute between first and second vertical angles, means for discharging one golf ball when the ball chute is in the first vertical angle, a set arm having a home position and a tee position, means associated with the set arm for receiving the one golf ball, when the set arm is in the home position, means for setting the one golf ball on a tee when the set arm is in the teeing position, and a plurality of partition plates dividing an inside of the means for storage, and the partition plates being positioned to let golf balls flow smoothly from a top to a bottom of the means for storage.

According to a further feature of the invention, there is provided an automatic golf-ball supplying device comprising: means for storing a plurality of golf balls, a ball chute, means for swinging the ball chute between first and second vertical angles, means for discharging one golf ball when the ball chute is in the first vertical angle, a set arm having a home position and a tee position, means associated with the set arm for receiving the one golf ball, when the set arm is in the home position, means for setting the one golf ball on a tee when the set arm is in the teeing position.

According to a still further feature of the invention, there is provided an automatic golf-ball supplying device comprising: means for storing at least one golf ball, a ball chute, means for swinging the ball chute between first and second vertical angles, means for discharging one golf ball when the ball chute is in the first vertical angle, a set arm having a home position and a delivery position, means associated with the set arm for receiving the one golf ball, when the set arm is in the home position, means for delivering the one golf ball to a using position when the set arm is in the delivery position, the delivery position being one of a first delivery position and a second delivery position, means, when the set arm is in the first delivery position, to deliver the one golf ball on a tee, and means, when the set arm is in the second delivery position, to deliver the golf ball on a mat, whereby practice with an iron is enabled.

According to a still further feature of the invention, there is provided an automatic golf-ball supplying device comprising: a stocker unit, the stocker unit including means for storing a plurality of golf balls, a ball chute, the ball chute including means for permitting lining up golf balls supplied from the stocker unit, means for swinging the a ball chute between first and second vertical angles, means for discharging one golf ball when the ball chute is at the first vertical angle, a set arm, the set arm including a ball-receiving end with a ball-supplying end, means for moving the set arm between a home position and a tee position, and agitation means, synchronized with swinging of the ball chute, for giving a back-and-forth shaking to golf balls lined up on the ball chute.

According to a still further feature of the invention, there is provided an automatic golf-ball supplying device comprising: a stocker unit, means in said stocker unit for storing a plurality of golf balls, a ball chute, means for lining up a plurality of golf balls on the ball chute, means for swinging the ball chute between first and second vertical positions, means for discharging one golf ball when the ball chute swings to the first vertical position, a set arm, the set arm including a ball-receiving end and a ball-supplying side, means for moving the ball-supplying side between a home position and a teeing position, and a holding means for holding the set arm at the home position and at the teeing position.

According to another feature of the invention, there is provided an automatic golf-ball supplying device comprising: a stocker unit capable of storing a plurality of golf balls, a chute unit including means for lining up golf balls from the stocker unit on a ball chute rotatably supported on the chute unit and for discharging golf balls one ball at a swing of the ball chute, the set arm including first and second ball delivery positions, means, effective, when the set arm is in the first ball delivery position, for delivering a ball on a tee, and mat-delivery means, effective, when the set arm is in the second ball delivery position, for delivering at least one ball on a mat.

According to yet another feature of the invention, there is provided an automatic golf-ball supplying device comprising: a stocker unit capable of storing a plurality of golf balls, a set arm, means for delivering one golf ball to the set arm, means for rotating the set arm to a teeing position, means for permitting detachment of the set arm in the event it is struck by a golf club, and means for limiting a distance which the set arm may travel when detached by being struck.

According to another feature of the invention, there is provided an automatic golf-ball supplying device comprising: a stocker unit capable of storing a plurality of golf balls, a chute unit including means for lining up golf balls from the stocker unit on a ball chute rotatably supported on the chute unit and for discharging golf balls, one golf ball at a swing of the ball chute, means for delivering the one golf ball to a using position; and a card system for counting a number of golf balls used and for subtracting that number from a pre-paid card.

According to another feature of the invention, there is provided an automatic golf-ball supplying device comprising: a stocker unit capable of storing a plurality of golf balls, a chute unit including means for lining up golf balls from the stocker unit on a ball chute rotatably supported on the chute unit and for discharging golf balls, one golf ball at a swing of the ball chute, means for delivering the one golf ball to a using position; and the stocker unit being removable.

According to another feature of the invention, there is provided an automatic golf-ball supplying device comprising: a stocker unit capable of storing a plurality of golf balls, a chute unit including means for lining up golf balls from the stocker unit on a ball chute rotatably supported on the chute unit and for discharging golf balls, one golf ball at a swing of the ball chute, means for delivering the one golf ball to a using position, and a sensor for energizing the means for delivering when the infrared sensor detects absence of a ball at the delivery position.

According to a further feature of the invention, there is provided an automatic golf-ball supplying device comprising: a stocker unit capable of storing a plurality of golf balls, a chute unit including means for lining up golf balls from the stocker unit on a ball chute, first rotating means for rotating the ball chute unit and for discharging golf balls, one golf ball at a swing of the ball chute, a set arm receiving the one golf ball from the chute unit, second rotating means for rotating the set arm between a home position and a position delivering the one golf ball to a using position, and separate driving sources for the first rotating means and the second rotating means.

According to another feature of the invention, there is provided an automatic golf-ball supplying device comprising: a stocker unit capable of storing a plurality of golf balls, a chute unit including means for lining up golf balls from the stocker unit on a ball chute rotatably supported on the chute unit and for discharging golf balls, one golf ball at a swing of the ball chute, means for delivering the one golf ball to a using position, and the using position being one of a mat and a tee.

The above, and other objects, features and advantages of the invention will become apparent from the following description of the preferred embodiment read in conjunction with the accompanying drawings, in which like reference numerals designate the same elements.

DETAILED DESCRIPTION OF THE PREFERRED EMBODIMENT

Figure 1:
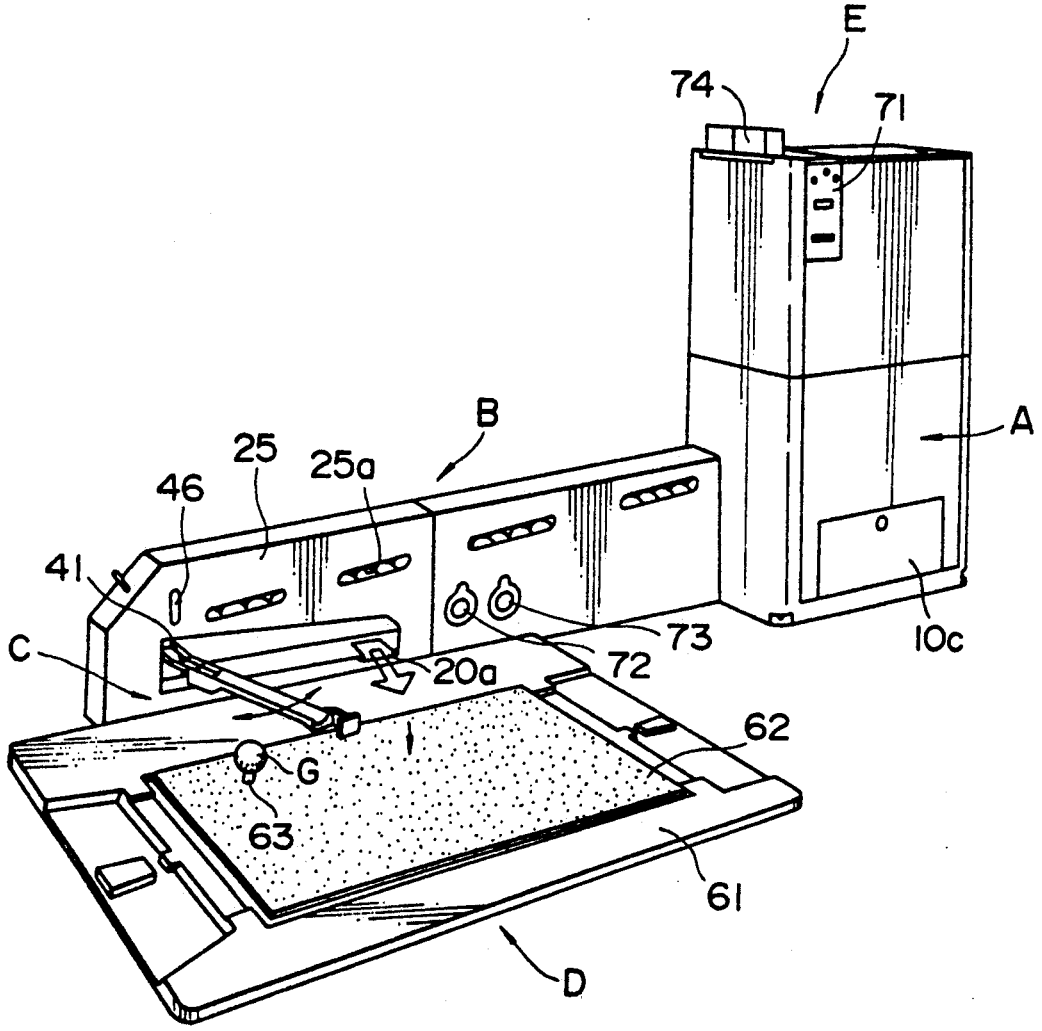
FIG. 1 is a perspective drawing of a preferred embodiment of the present invention.

Referring to FIG. 1 there is shown an automatic golf ball dispenser 100 that includes five major units. A stacking unit A stores and supplies golf balls G to a chute unit B. Chute unit B is housed in a narrow rectangular enclosure 25 whose upper left corner terminates obliquely. Chute unit B transports golf balls G from stacking unit A to a setting arm unit C in enclosure 25.

A swingable set arm 41 of setting arm unit C accepts golf balls G from chute unit B and positions them on a tee 63. A chute 20 located at a rear side portion of setting arm unit C can be used to dispense golf balls G to a shot mat 62 for hitting iron shots directly from a surface of shot mat 62. A box shaped control unit E contains the controls used to operate dispenser 100.

Control unit E, located on top of stacking unit A, contains a card reader 71 on an upper right hand corner and a condition indicator 74 on a forward upper surface, as shown on the figure. Condition indicator 74 lights green to indicate that dispenser 100 is on and operating, and lights red to indicate a trouble or malfunction. Card reader 71 reads a card to set in a quantity of prepaid golf balls G for dispenser 100 to dispense to a user.

Along the side of chute unit B facing a mat unit D, a plurality of viewing ports 25*a* allow a user to determine that a supply of golf balls G are loaded in dispenser 100. The side of chute unit B also contains a stop button 73 to stop dispenser 100 and an iron button 72, which causes dispenser 100 to dispense a plurality of golf balls G through a chute 20*a* directly to shot mat 62 of a base mat 61 on mat unit D. Golf balls G, on shot mat 62, permit practice with an iron.

Figure 2A:
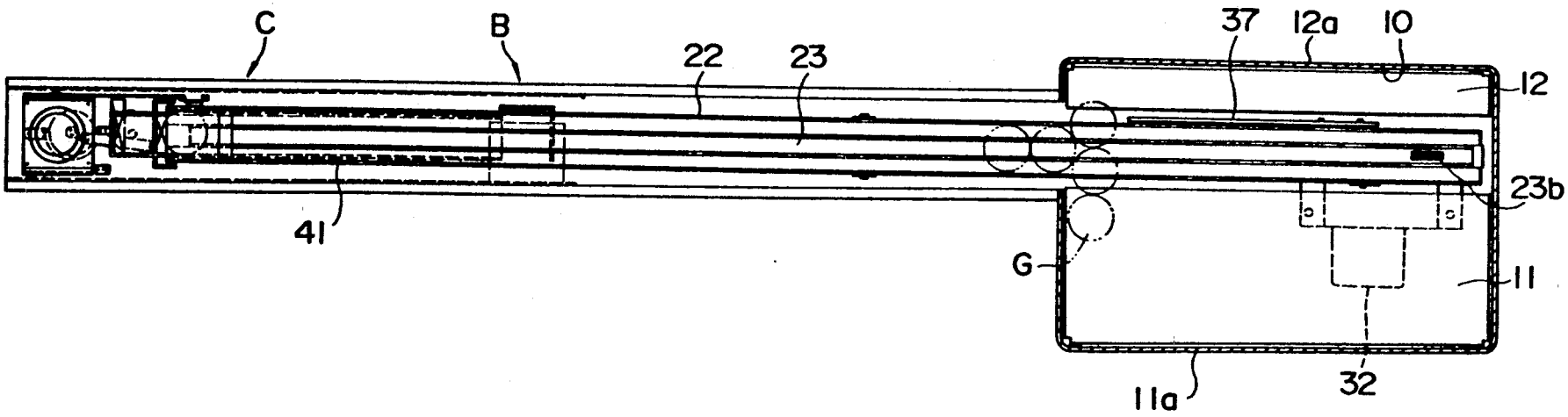
FIG. 2A is a cutaway top view of the ball storage, chute, and setting arm units the invention of FIG. 1.
Figure 2B:
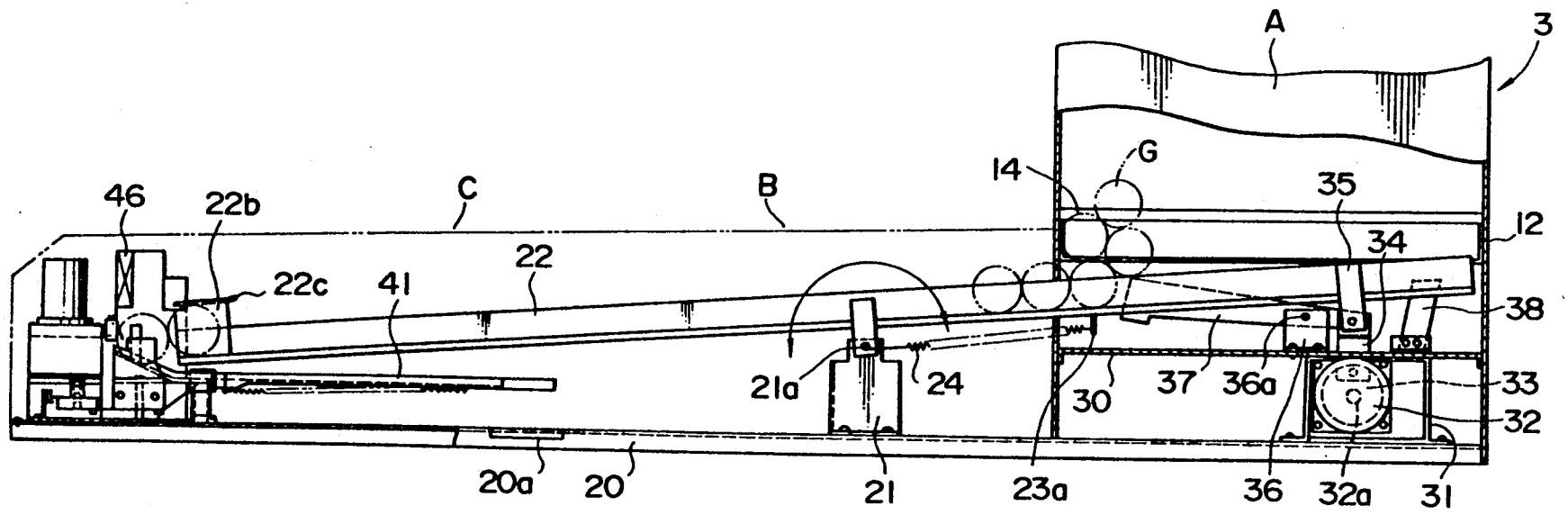
FIG. 2B is a cutaway side view of the units of FIG. 2A.

Referring to FIGS. 2A and 2B, a base 20 supports stacking unit A, chute unit B and setting arm unit C in line. Mounted on a left hand portion of base 20, stacking unit A generally comprises a rectangular box 10 having a maintenance door 10*c* (shown in FIG. 1) on its side. A chute 22, which has a roughly "U"-shaped cross section, extends at one end from chute unit B into box 10 at a point approximately one half the distance closer to a side wall 12*a* than a side wall 11*a*. A second end of chute 22 terminates at a point adjacent to setting arm unit C with a gate 22*b*. A visor 22*c*, disposed across a top member of gate 22*b* facing away from setting arm unit C, serves to guide golf balls G through gate 22*b*.

Within box 10, a plate 11, that extends from a rear wall 10*a* to a front wall 10*b*, slants downward from a sidewall 11*a* to a position adjacent to a first side of chute 22, while a plate 12 that extends from rear wall 10*a* to front wall 10*b* slants downward from side wall 12*a* to a position adjacent to a second side of chute 22. Plate 11 and a plate 12 form a trap that guides golf balls G to chute 22 and prevents them from falling to the area below chute 22.

Figure 2C:
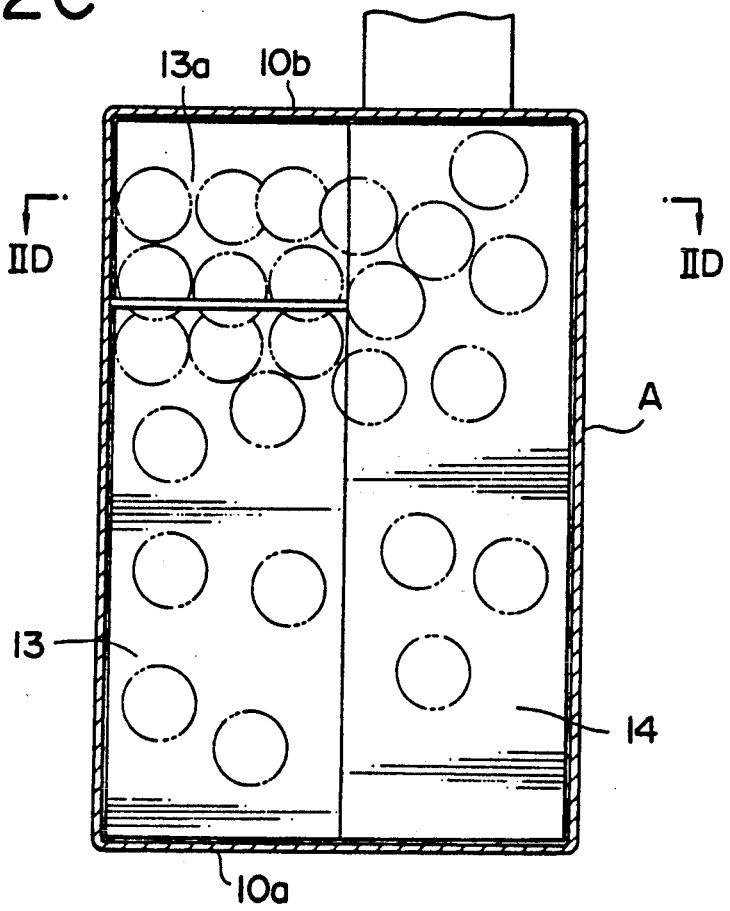
FIG. 2C is a top cross section of the storage unit.
Figure 2D:
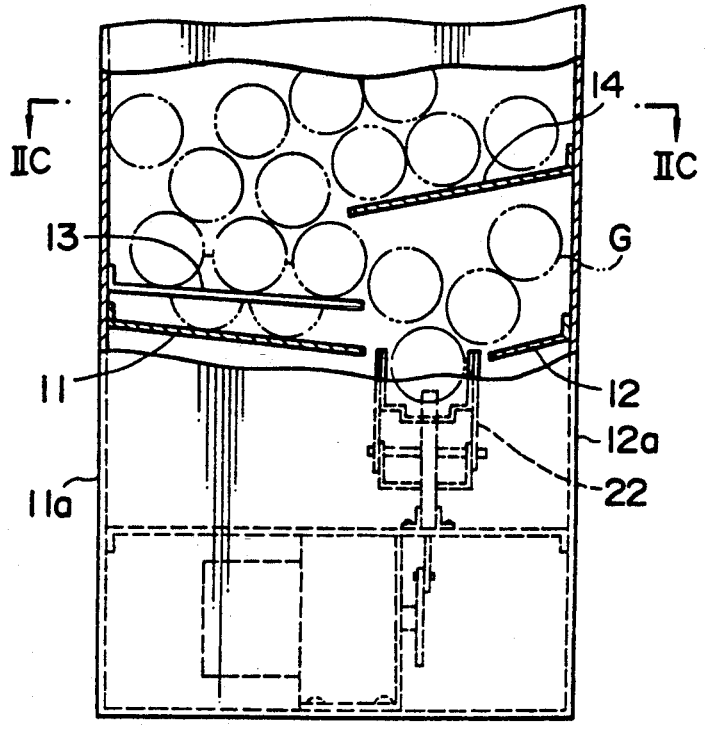
FIG. 2D is a side cross section of the storage unit of FIG. 2C

Referring to FIGS. 2C and 2D, an upper baffle plate 14 that extends from rear wall 10*a* to front wall 10*b* is disposed above plate 12 and slopes downward from side wall 12*a* approximately halfway across box 10. A free edge of upper baffle plate 14 extends over chute 22. A lower baffle plate 13, that extends from rear wall 10*a* approximately three fourths of the distance to front wall 10*b*, slopes slightly downward from side wall 11*a* to a position above the first side of chute 22 and just under the free edge of upper baffle plate 14.

Referring again to FIGS. 2*a* and 2*b* chute 22 is pivotally connected to a stand 21 on base 20 by a pivot 21*a*. This allows chute 22 to be held parallel to base 20 or slanted downward from box 10. A groove 22*a* runs the length of the bottom of chute 22 to guide golf balls G along chute 22. A sliding rail 23 is slidably disposed along the length and within groove 22*a*. A pin 23*a*, attached to a bottom surface of sliding rail 23, projects downwardly through a slot (not shown) in the bottom of groove 22*a*. A return spring 24 is connected between pin 23*a* and stand 21 to bias sliding rail 23 to its forwardmost position (left in the figures). A motor 32 is secured to base 20 by a bracket 31, both disposed under a horizontal plate 30.

Figure 3A:
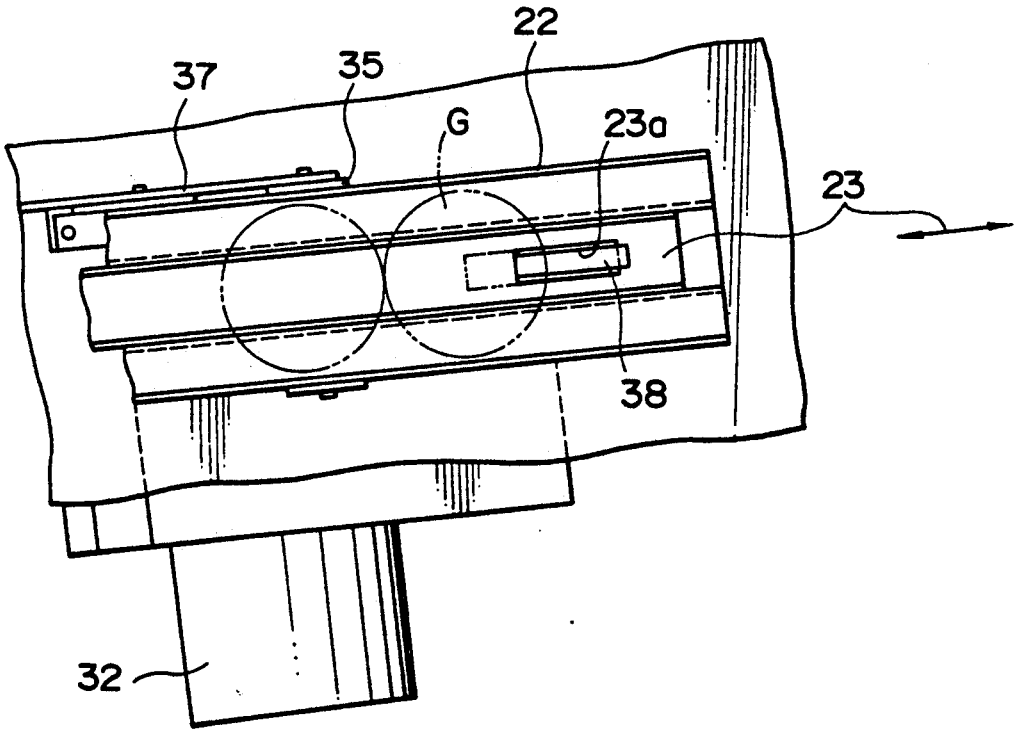
FIG. 3A is a partial top cutaway view of the chute unit of FIG. 1 at the ball exit area of the storage unit.
Figure 3B:
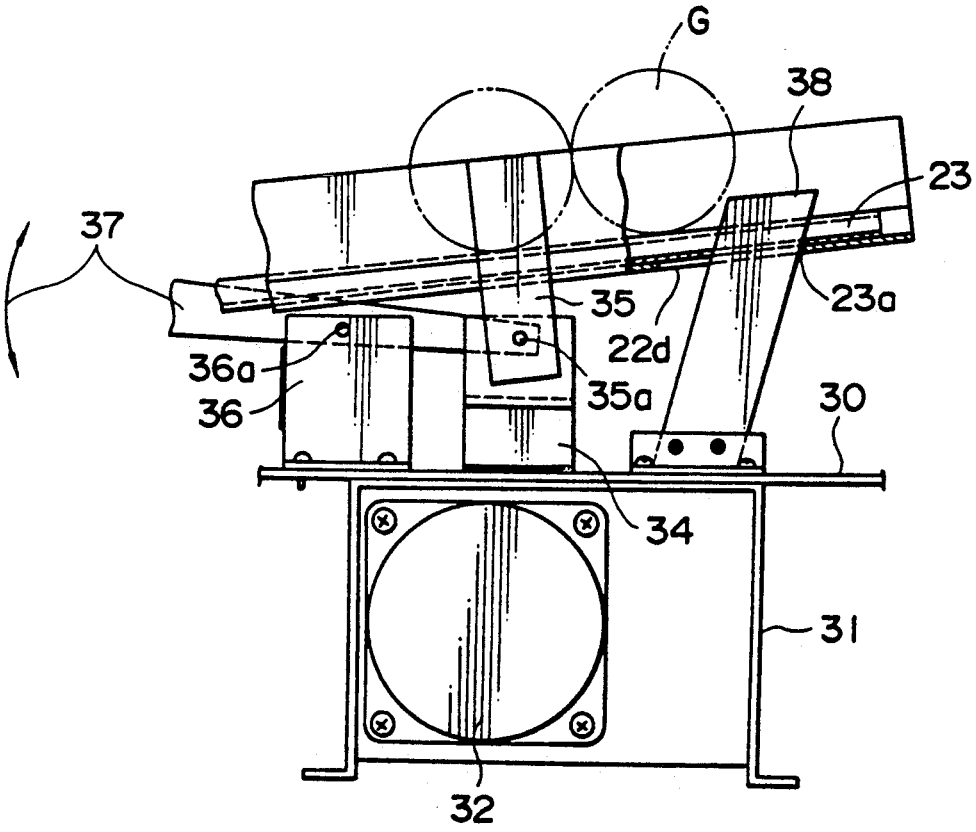
FIG. 3B is a side view of FIG. 3A.
Figure 3C:
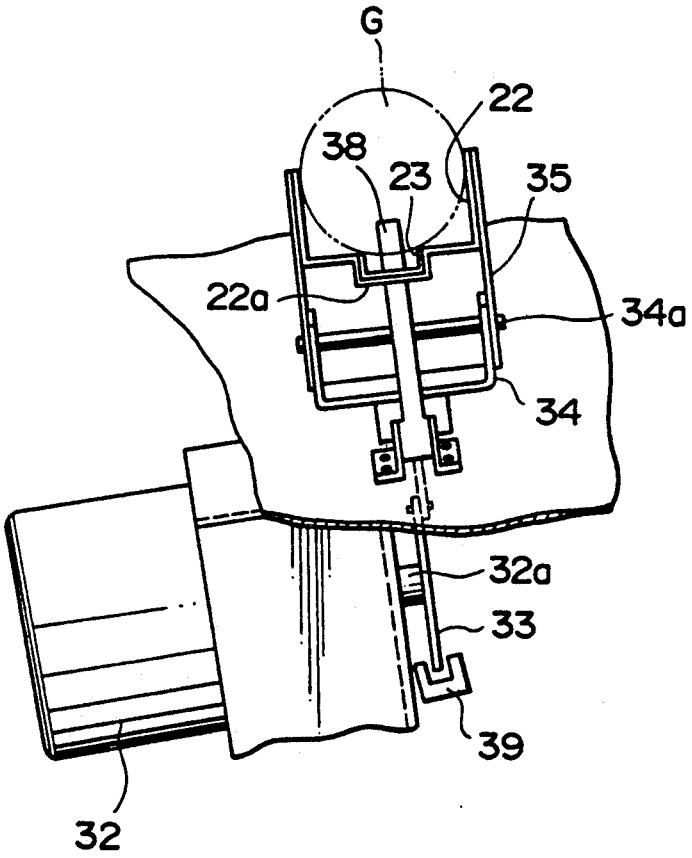
FIG. 3C is a cross sectional view of FIG. 3A

Referring to FIGS. 3A, 3*b*, and 3*c*, a rotary crank 33 is drivably connected by a shaft 32*a* of motor 32. The rotational position of crank 33 is monitored by a photo sensor 39. A crank arm 34, which extends through horizontal plate 30, is pivotally connected at one end to crank 33. A second end of crank arm 34 is pivotally connected to a bottom end of a frame 35 of chute 22 and a rear end of a bar 37. A pin bracket 36, mounted on horizontal plate 30, pivotally supports bar 37 by a pin 36*a*. A forward portion of bar 37 extends along a first side of chute 22. A cam 38 is mounted on a rear central upper surface of horizontal plate 30 so as to extend upward at a slight rearward angle through a slot 22*d* in chute 22 and a slot 23*b* in sliding rail 23.

Figure 4A:
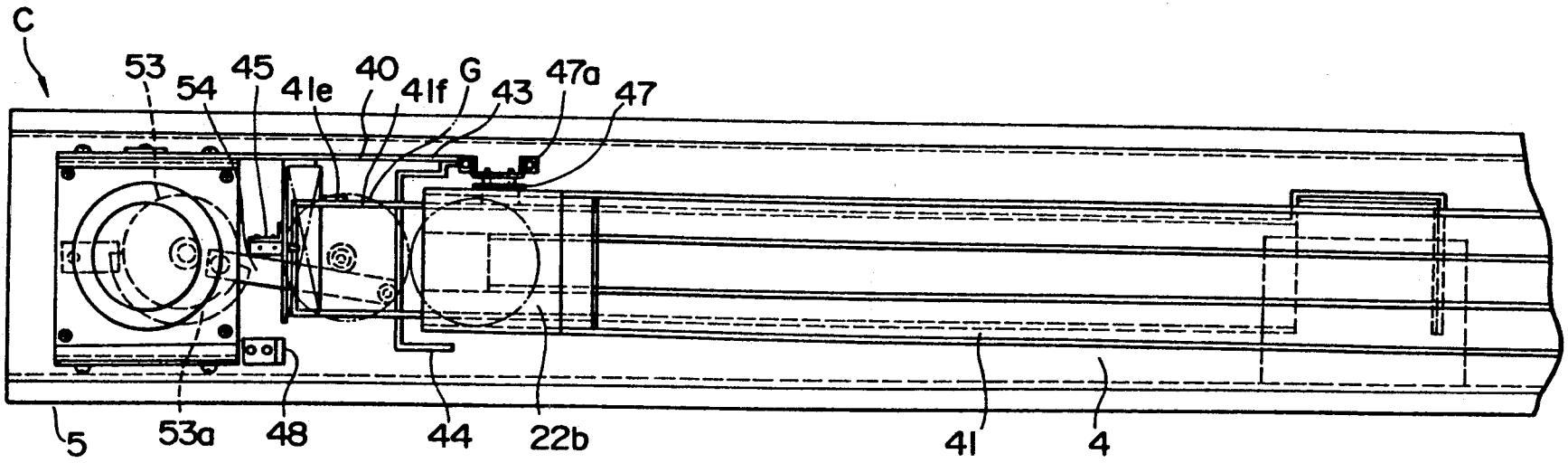
FIG. 4A is a partial top cutaway view of the set arm end of chute unit showing the set arm in its home position.
Figure 4B:
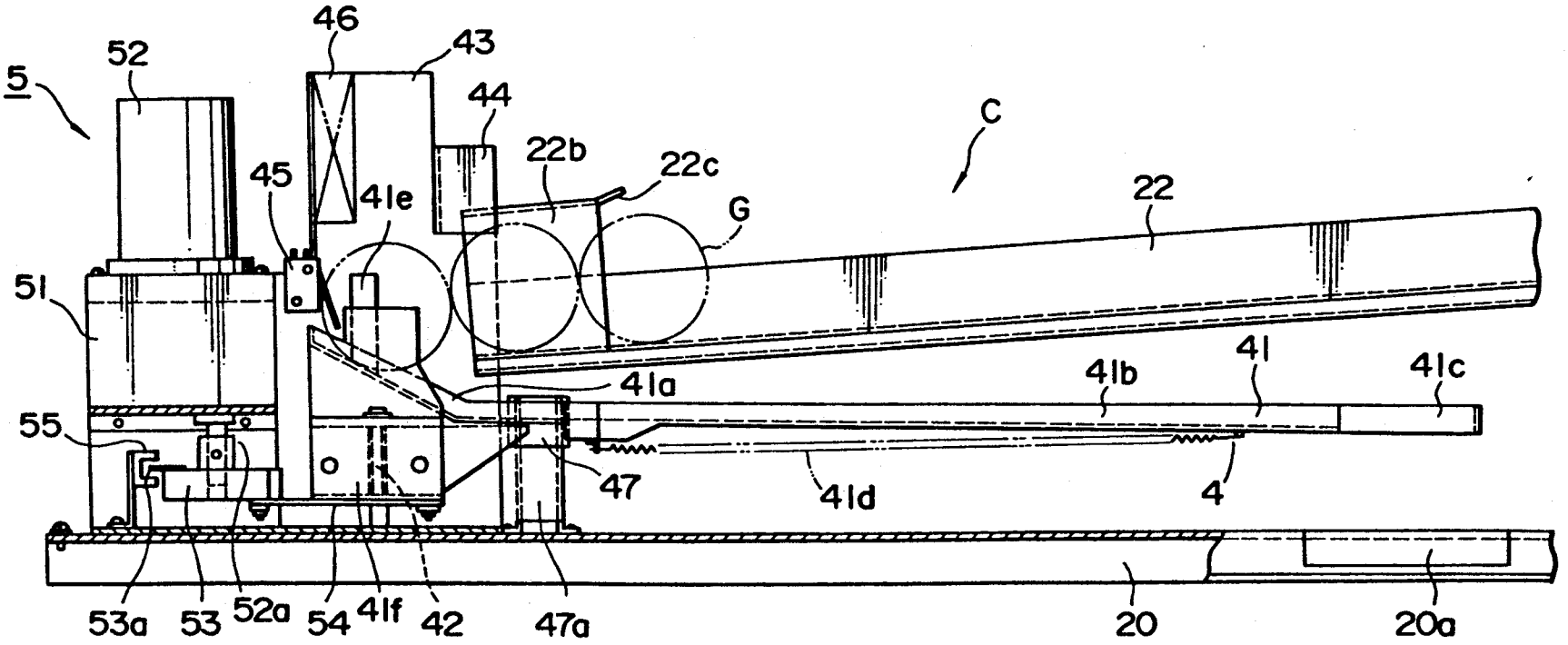
FIG. 4B is a side view of FIG. 4A.

Referring now to FIGS. 4A and 4B, setting arm unit C comprises an arm assembly 4 and an arm drive assembly 5. A set arm 41 of arm assembly 4 is rotatably supported at a ball receiver 41*a* end on a vertical shaft 42 by a support structure 41*f* so that the set arm 41 can be rotated outward from dispenser 100. An upward projection of support structure 41*f*, together with a stopper plate 41*e* form a golf ball guide assuring that golf balls G from chute 22 are properly positioned on ball receiver 41*a*, which is bent upwards to receive them.

A guide rail 41*b* portion of set arm 41 is separably joined to ball receiver 41*a*. Guide rail 41*b* is separably attached to minimize the possibility of severe damage to dispenser 100 should set arm 41 be struck accidentally by a golf club swing. If struck, guide rail 41*b* readily separates from ball receiver 41*a*, thus avoiding damage to ball receiver 41*a* and its supporting mechanism. A spring 41*d*, connected between ball receiver 41*a* and guide rail 41*b*, prevents guide rail 41*b* from being driven far from dispenser 100. Guide rail 41*b* can easily be rejoined to ball receiver 41*a* when separated.

A "U"-shaped ball supplier 41*c* is disposed at an end of guide rail 41*b* away from ball receiver 41*a*. An open side of ball supplier 41*c* faces away from dispenser 100 in the direction of its travel. A magnet holder 47*a* is mounted on base 20 between set arm 41 and a wall of setting arm unit C away from the direction of travel of set arm 41. A magnet 47, attached to magnet holder 47*a*, holds set arm 41 in place while it is in a golf ball G receiving position.

Figure 5:
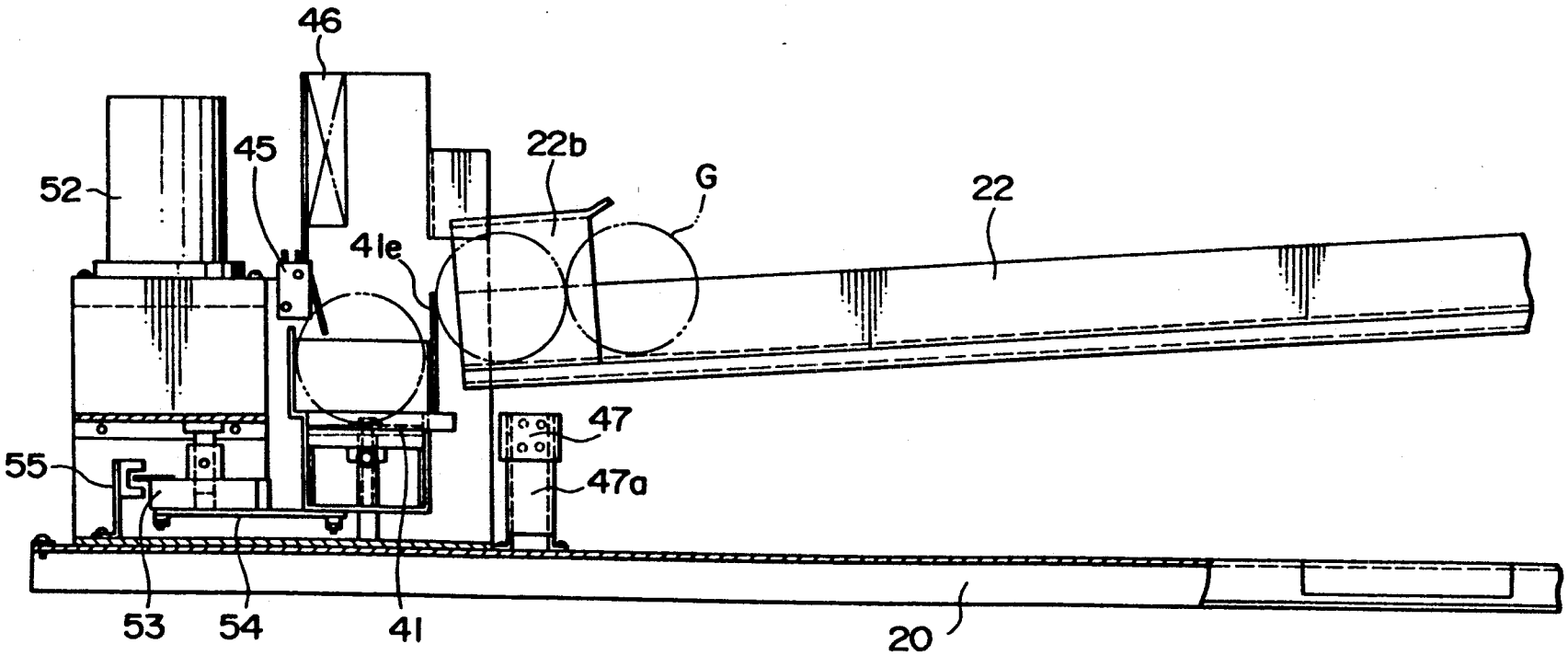
FIG. 5 is a side view of FIG. 4A with the set arm unit in the tee position.

Components of arm drive assembly 5 are generally located at an end of base 20 opposite box 10. A bracket 51, mounted on an end of base 20, supports a motor 52. A shaft 52*a* of motor 52 drives a crank 53, which is coupled to a bottom of support structure 41*f* by a crank arm 54. Rotation of crank 53 causes crank arm 54 to pull against support structure 41*f*, causing set arm 41 to swing between the golf ball receiving position and a golf ball tee up position shown in FIGS. 5 and 8. A photo sensor 55, mounted on base 20 adjacent to a perimeter of crank 53, senses a detector plate 53*a* to determine the instantaneous position of set arm 41. A magnet 48 is mounted on base 20 in the rotational path of a stopper plate 44 on set arm 41. When set arm 41 is being swung to the tee up position, its motion is blocked at the correct position as stopper plate 44 contacts magnet 48. Magnet 48 then magnetically holds set arm 41 in position until it is returned to its receiving position by the action of motor 52. An infra-red sensor 46 is mounted on a wall 43 of setting arm unit C with line of sight contact with tee 63 to sense the presence of a golf ball G.

Referring again to FIG. 1, mat unit D includes a base mat 61 that is positioned against, and centered with, setting arm unit C. Shot mat 62 is centered on base mat 61 to provide a realistic surface for practicing with irons. Tee 63 is mounted on shot mat 62 in a precise position to receive golf balls G from setting arm unit C.

Figure 10:
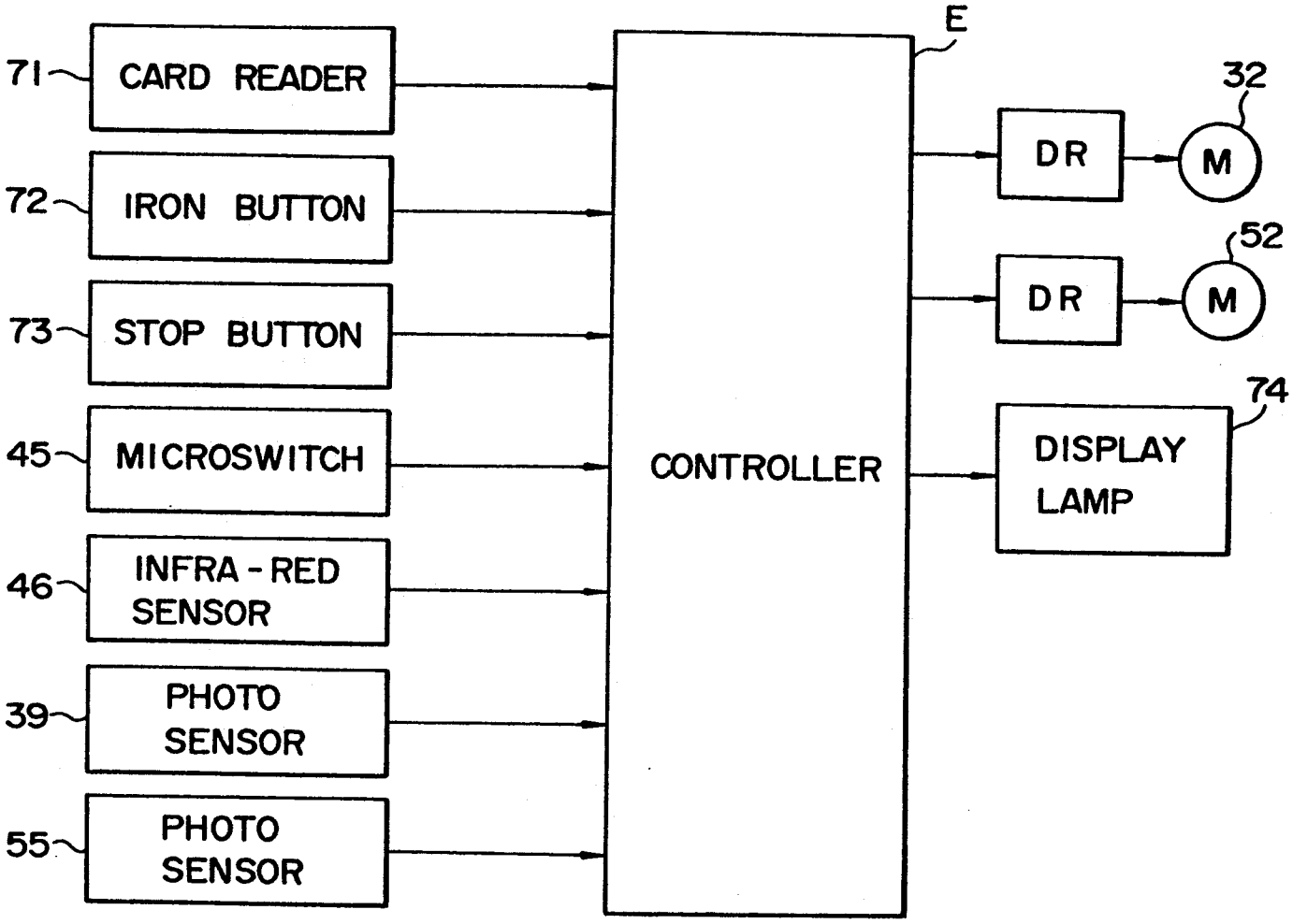
FIG. 10 is a block diagram of a control unit according to a preferred embodiment of the present invention.

Referring to FIG. 10, there is shown a block diagram of control unit E. Control unit E determines a required operating sequence depending on input signals from a variety of sources. These sources include card reader 71, iron button 72, stop button 73, a microswitch 45, infra-red sensor 46, and photo sensor 55. Using these input signals, control unit E generates control signals to operate motors 32 and 52 to carry out all required sequences of operation. The controller also uses these inputs to monitor the condition of dispenser 100 and light indicator 74 green or red as required.

Figure 11:
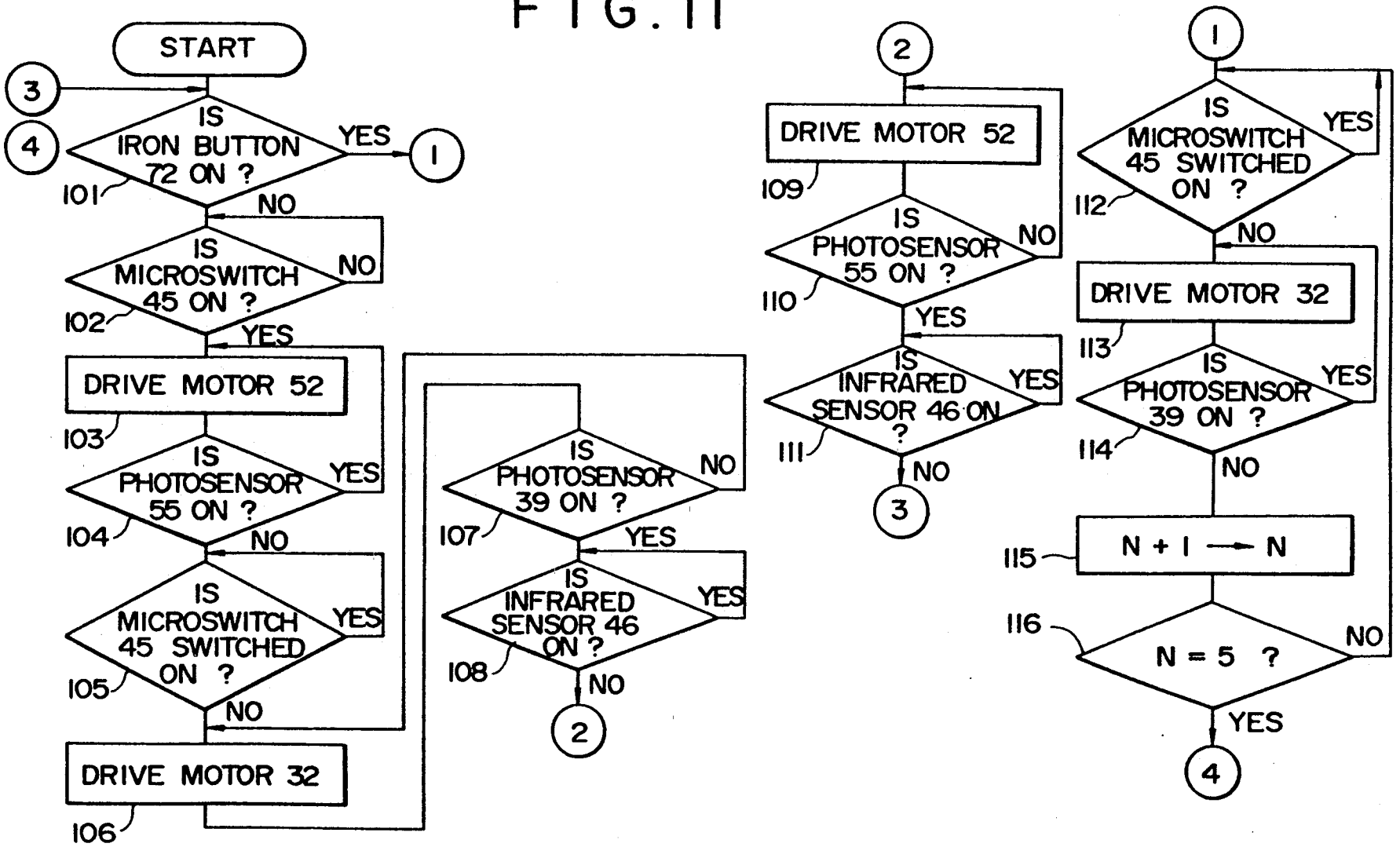
FIG. 11 is a flow chart giving the sequence of the controller operations.

Referring to FIG. 11, dispenser 100 operates in the following sequence. Initially, chute 22 is loaded with a plurality of golf balls G with the foremost golf ball G in position on ball receiver 41*a* of set arm 41. With the insertion of a card in 71, operation is initiated. Control unit E determines whether or not iron button 72 has been pressed (101) and if microswitch 45 has been closed by a golf ball G on ball receiver 41*a* (102). If iron button 72 is not pressed and microswitch 45 is closed, control unit E sends a drive signal to motor 52 (103). Shaft 52*a* rotates, causing crank 53 and crank arm 54 to swing set arm 41 from a ball receiving position, shown in FIG. 4B, to a tee position, shown in FIG. 5.

Figure 6:
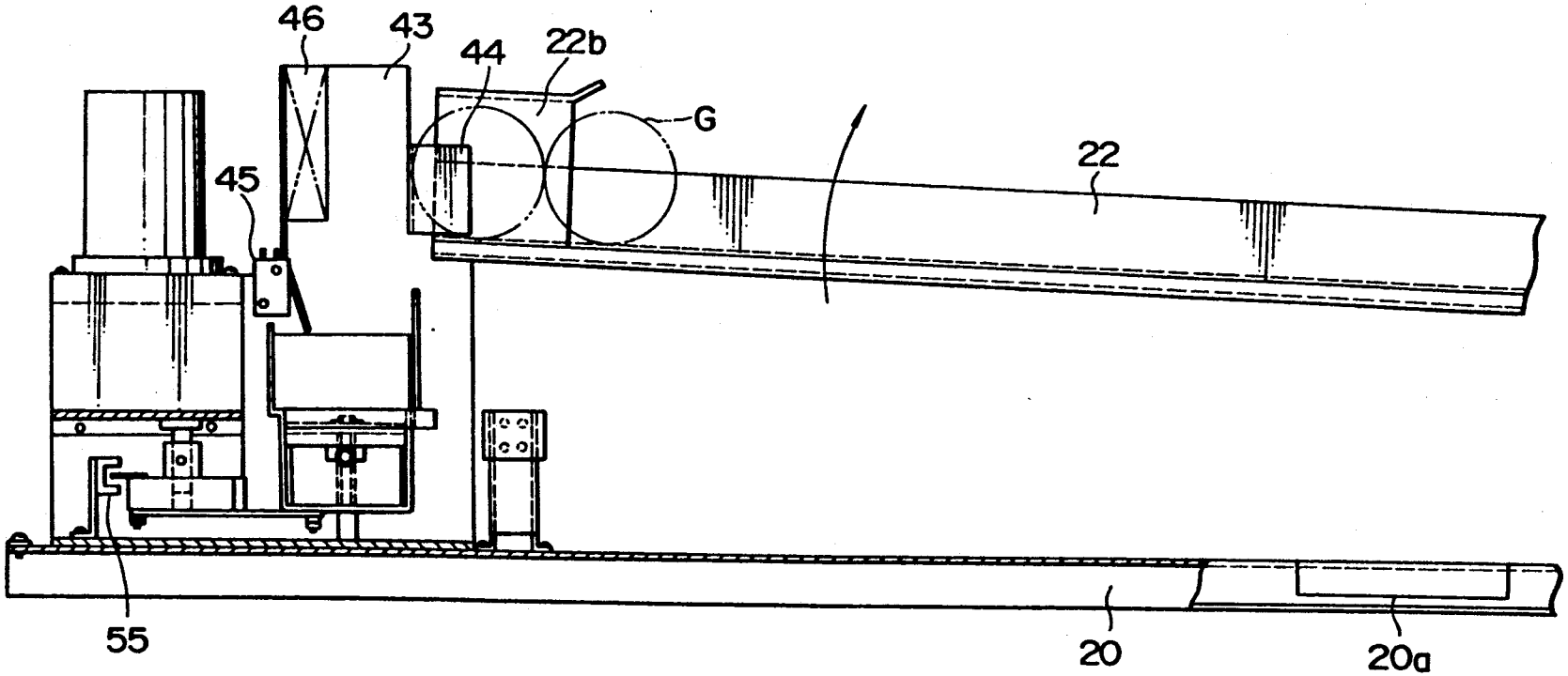
FIG. 6 is the view of FIG. 5 with the chute unit elevated.
Figure 8:
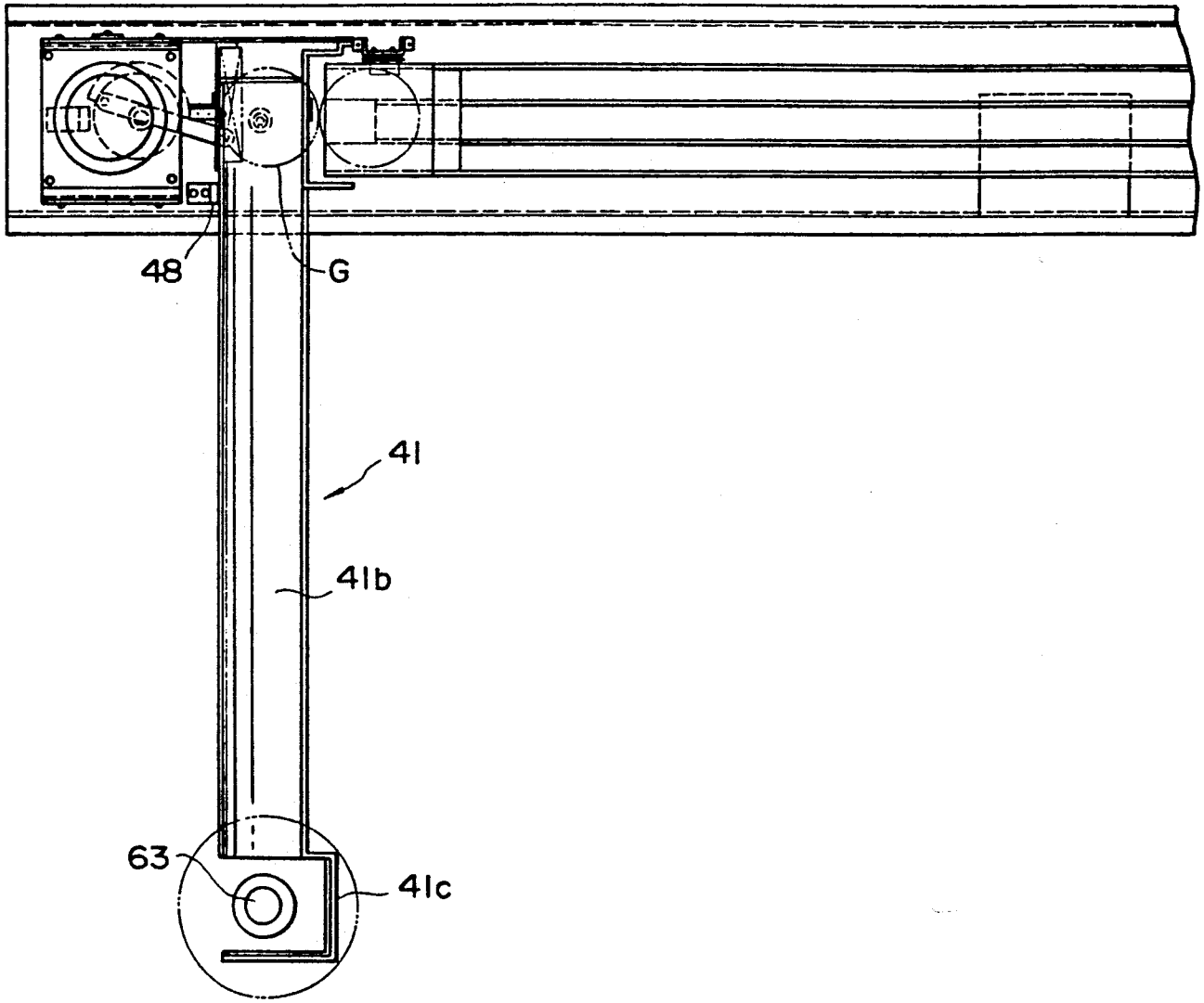
FIG. 8 is a top view of FIG. 5.

When set arm 41 is in the tee position, detector plate 53*a* is detected by photo sensor 55 (104). Motor 52 is stopped. Stopper plate 41*e* pushes backward on the row of golf balls G that are pressing against the foremost golf ball G, thus allowing the foremost golf ball G to roll down set arm 41 to ball supplier 41*c* and be placed on tee 63. Proper placement of golf ball G on tee 63 is assured by magnet 48, which firmly positions set arm 41 as shown in FIG. 8. Micro switch 45 is opened as golf ball G leaves ball receiver 41*a* (105). Control unit E sends a drive signal to motor 32 causing it to rotate crank 33 (106). This pulls crank arm 34 down to pivot chute 22 clockwise on pivot 21*a*, as shown in FIG. 6. With chute 22 raised to a horizontal position, gate 22*b* is closed by stopper plate 44, thus preventing the next golf ball G from dropping into ball receiver 41*a*. This allows set arm 41 to be returned to its receiving position without interference from a golf ball G.

As motor 32 continues to rotate, chute 22 is pivoted counterclockwise. At the same time, bar 37 pivots around pin 36*a* and is lifted into the stack of golf balls G to prevent any clogging. In addition the clockwise and counterclockwise motion of chute 22 causes cam 38 to move sliding rail 23 back and forth to further prevent any stoppage in the flow of golf balls G along chute 22. When photo sensor 39 detects a half revolution of crank 33, motor 32 is stopped at its start position (107).

Figure 7:
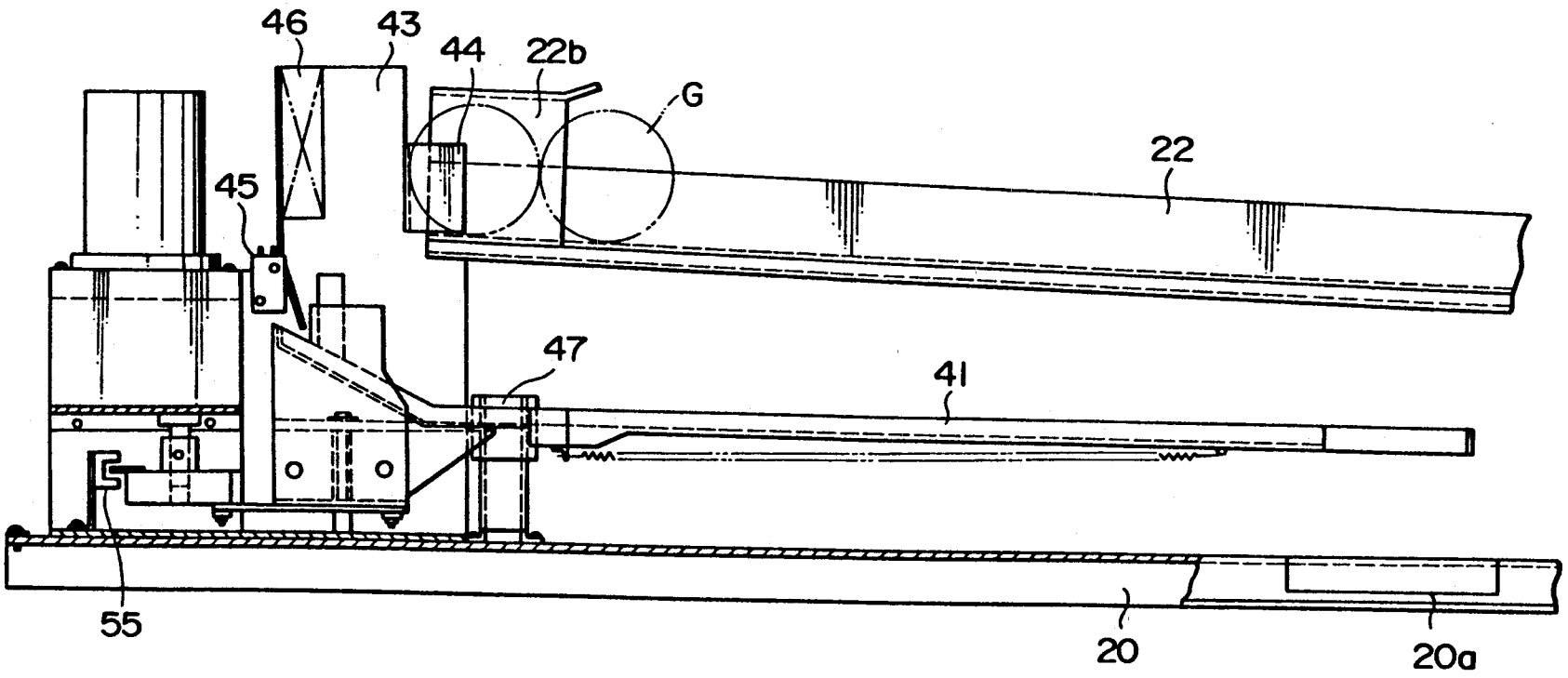
FIG. 7 is the view of FIG. 4B with the chute unit elevated.

When infra-red sensor 46 (shown on FIG. 6) detects a golf ball G on tee 63 (108), control unit E drives motor 52 (109) to return set arm 41 to its receive position. When photo sensor 55 detects detector plate 53*a* (110) at half revolution of crank arm 54, indicating that set arm 41 is back in its receive position, as shown in FIG. 7, the cycle is completed (111).

After the golf ball G on tee 63 is driven, infra-red sensor 46 senses that golf ball G is not on tee 63 and the operating sequence is repeated until the number of golf balls G set into card reader 71 is used up.

Figure 9:
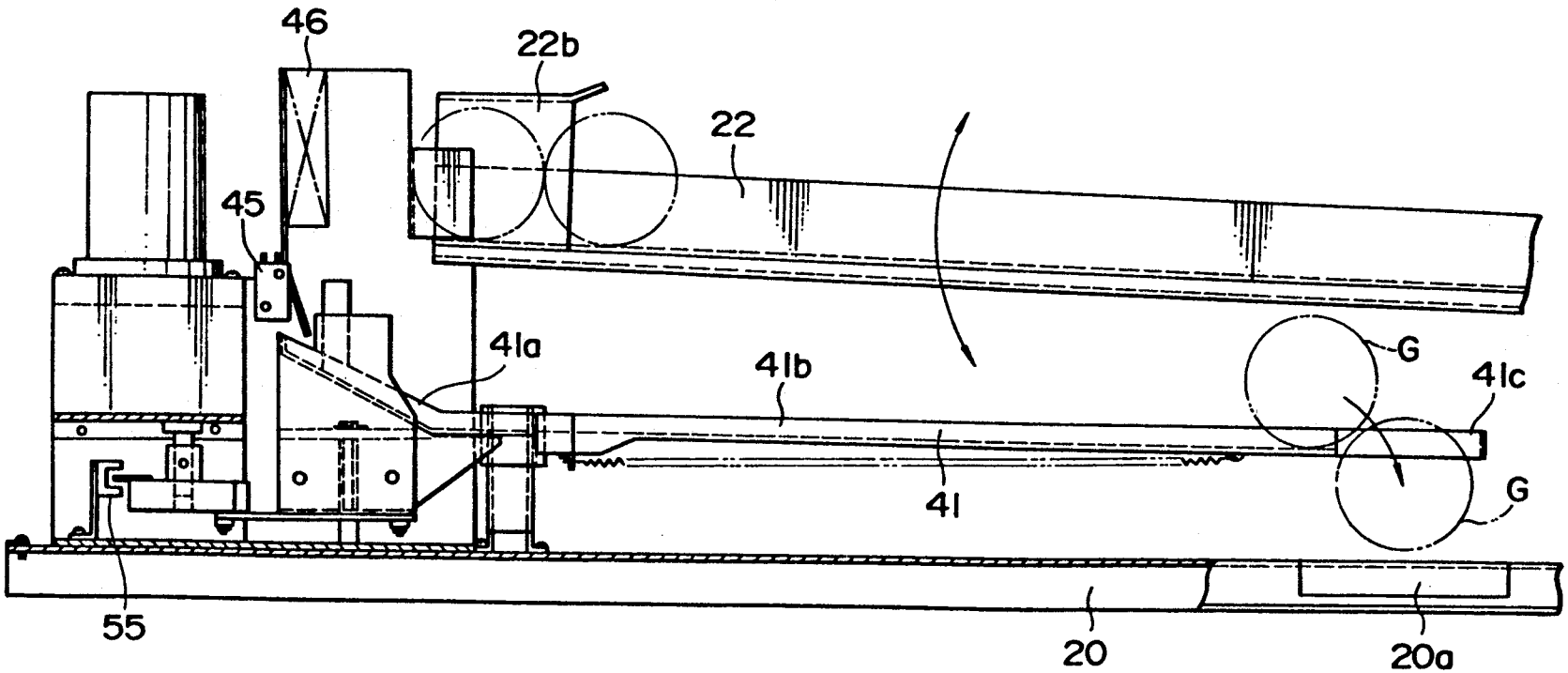
FIG. 9 is the view of FIG. 7 showing a plurality of balls provided without positioning on a tee.

After a pre-paid card is inserted in card reader 71, if iron button 72 is pressed (101) and microswitch 45 is closed by a golf ball G (112) on ball receiver 41*a*, as shown in FIG. 2B, control unit E sends a drive signal to motor 32 (113). Motor 32 rotates crank 33, causing chute 22 to pivot clockwise and counterclockwise until photo sensor 39, shown in FIG. 3C, senses that crank 33 has completed one revolution (114). With set arm 41 maintained in the receiving position, as shown in FIG. 9, golf ball G is rolled along set arm 41 and drops through ball supplier 41*c* to ramp 20*a* to roll onto shot mat 62 as shown in FIG. 1. This procedure can be repeated up to five times in this embodiment of the invention or up to the number n, set into card reader 71 (115 and 116).

Figure 12A:
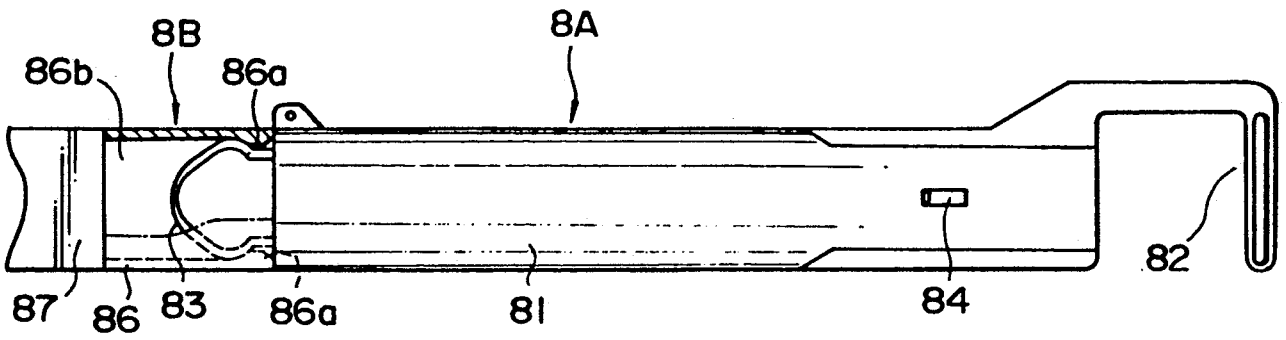
FIG. 12A is a top view of a setting arm according to a second embodiment of the invention.
Figure 12B:
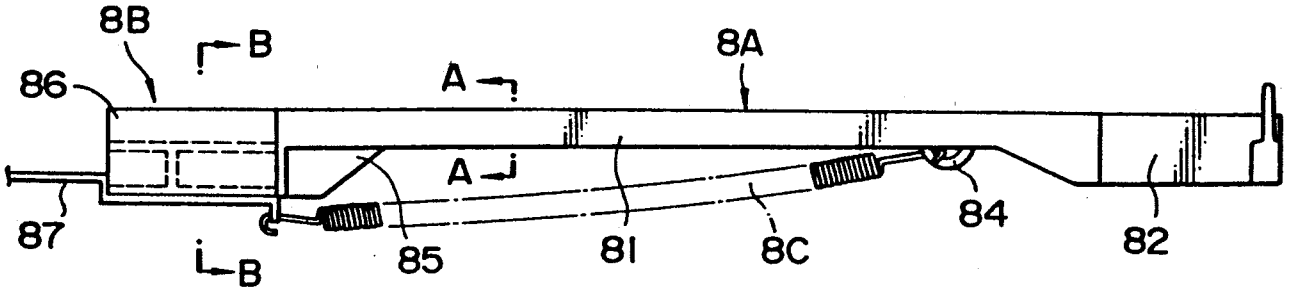
FIG. 12B is a side view of FIG. 12A.
Figure 12D:
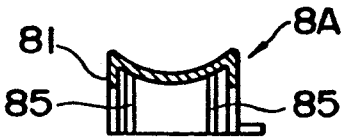
FIG. 12D is a cross section of FIG. 12B taken at A—A.

Referring now to FIGS. 12A and 12B, there is shown a second embodiment of the present invention using a set arm 80. In this embodiment, a lead portion 80*a*, that may be formed from a material such as a polycarbonate, includes a guide rail 81, that terminates at a first end with a "U"-shaped ball supplier 82, and at a second end in a spade shaped joint 83. The upper surface of guide rail 81 is convex, as shown in FIG. 12D, to form a guide path for golf balls G. A hook 84 is attached to a bottom surface of guide rail 81 at a position near the first end. A reinforcer 85 on the bottom surface of guide rail 81 is at the second end to strengthen the structure.

Figure 12C:
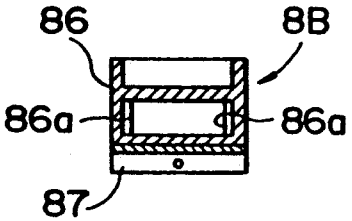
FIG. 12C is a cross section of FIG. 12B taken at B—B.

A base 80*b* of set arm 80 includes a holder 86, that may be formed from any convenient material such as, for example, a polycarbonate. Base 80*b* is supported by a metal plate board 87. Holder 86 includes a hollow chamber 86*b*, into which joint 83 of guide rail 81 may be inserted. A pair of protrusions 86*a* on inner side surfaces of hollow chamber 86*b* hold joint 83 removably in place. FIG. 12*c* is a cross sectional view of hollow chamber 86*b*. Board 87 is affixed to an under side of holder 86 to provide a means for stringing a resilient band 80*c*, such as a spring, loosely between board 87 and hook 84.

In use, should lead portion 80*a* be struck by a golf club, it separates from base 80*b* without damage. Band 80*c* prevents lead portion 80*a* from being driven far from dispenser 100. The operation of dispenser 100 using this embodiment is as previously described.

Figure 13A:
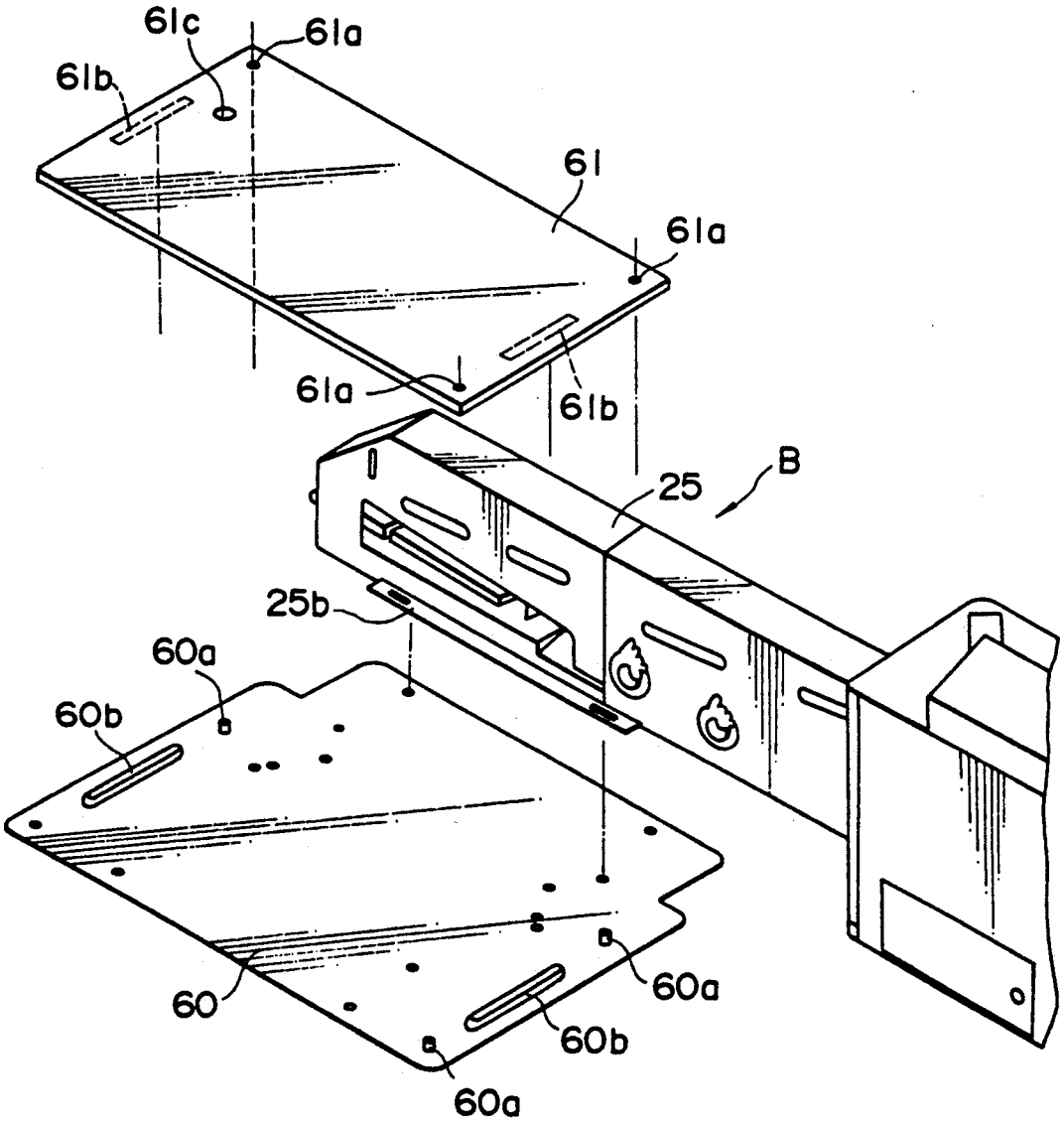
FIG. 13A is a perspective view of a mat unit according to a preferred embodiment of the invention.
Figure 13B:
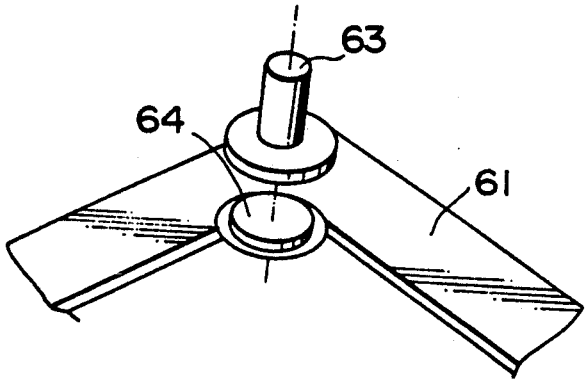
FIG. 13B is a perspective view of a tee attachment on the device of FIG. 13A.
Figure 13C:
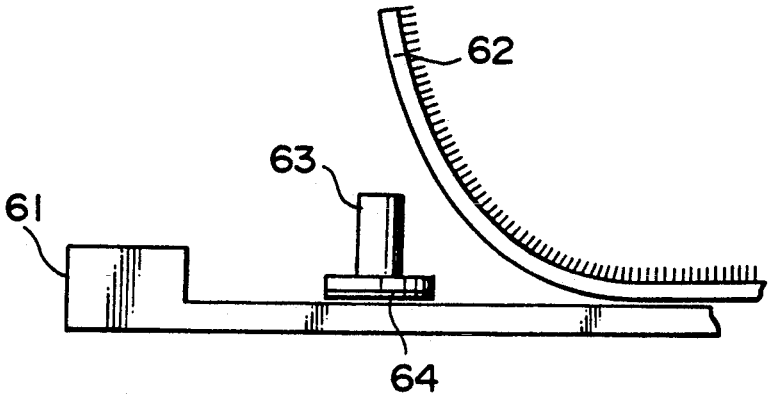
FIG. 13C is a cross section of the mat of FIG. 13A.

Referring to FIGS. 13A, 13B, and 13C there is shown an embodiment of the present invention where a mat unit 60 is attached to a mat attachment 25*b* on enclosure 25. A plurality of pins 60*a* and a pair of protrusions 60*b* engage holes 61*a* and recesses 61*b*, respectively, of base mat 61. As can be seen in FIG. 13*b*, a hole 61*c* in base mat 61 receives a tee base 64. Tee 63 is secured to tee base 64. Shot mat 62 covers base mat 61 as shown in FIG. 13C.

In still another embodiment of the invention, it is possible to use the invention with manual feed of golf balls G without a card reader. In this case, a stacking unit is not used. The user places a number of golf balls directly on a chute and the dispenser then tees them one at a time as described previously.

Having described the preferred embodiment os the invention with reference to the accompanying drawings, it is to be understood that the invention is not limited to those precise embodiments, and that various changes and modifications may be affected therein by one skilled in the art without departing from the scope or spirit of the invention as defined in the appended claims.

What is claimed is:

1. An automatic golf-ball supplying device comprising:
storage means for storing a plurality of golf balls;
a ball chute;
a set arm;
means for lining up golf balls from said storage means on said ball chute;
means for swinging said ball chute in a vertical direction between first and second angles;
said first angle being effective for permitting a ball to move onto said set arm;
said second angle being effective for preventing a ball from moving toward said set arm;
said set arm including a ball-receiving end and a ball-supplying end;
means for rotating said set arm between a home position and a tee position;
mixing means for mixing balls in said storage means, and
means for synchronizing said mixing means with a swing of said ball chute.

2. The automatic golf-ball supplying device of claim 1, wherein said mixing means includes:
a mixing bar;
means for rotatably supporting said mixing bar with one end thereof in a vicinity of a ball exit of said storage means,
said means for synchronizing including a connection between said ball chute and said mixing bar, whereby said mixing bar is rotated in synchronism with a swinging of said ball chute; and
at least a portion of said mixing bar moving toward and away from said ball exit during motion thereof.

3. Apparatus according to claim 2, wherein said at least a portion moves at least partly through said ball exit into said storage means.

4. An automatic golf ball supplying device comprising:
means for storing a plurality of golf balls;
a ball chute;
means for swinging said ball chute between first and second vertical angles;
means for discharging one golf ball when said ball chute is in said first vertical angle;
a rotatably mounted set arm having a home position and a teeing position;
means for horizontally rotating said set arm from said home position to said teeing position;
means associated with said set arm for receiving said one golf ball, when said arm is in said home position;
means for setting said one golf ball on one of a tee and a practice mat when said set arm is in a teeing position;
a plurality of partition plates dividing an inside of said means for storage; and
said partition plates being positioned to let said plurality of golf balls flow smoothly from a top to a bottom of said means for storing.

5. An automatic golf ball device comprising:
means for storing a plurality of golf balls;
a ball chute;
means for swinging said ball chute between first and second vertical angles;
means for discharging one golf ball when said ball chute is in said first vertical angle;
a rotatably mounted set arm having a home position and a teeing position;
means for horizontally rotating said set arm between said home position and said teeing position;
means associated with said set arm, for receiving said one golf ball when said set arm is in a home position;
means for setting said one golf ball on a tee when said set arm is in said teeing position; and
said means for setting including means for permitting said one golf ball to roll from said means for receiving into a position over a tee.

6. An automatic golf-ball supplying device comprising:
means for storing at least one golf ball;
a ball chute;
means for swinging said ball chute between first and second vertical angles;
means for discharging one golf ball when said ball chute is in said first vertical angle;
a set arm having a home position and a delivery position;
means associated with said set arm for receiving said one golf ball, when said set arm is in said home position;
means for delivering said one golf ball to a using position when said set arm is in said delivery position;
said delivery position being one of a first delivery position and a second delivery position;
means, when said set arm is in said first delivery position, to deliver said one golf ball on a tee; and
means, when said set arm is in said second delivery position, to deliver said golf ball on a mat, whereby practice with an iron is enabled.

7. An automatic golf-ball supplying device comprising:
a stocker unit;
said stocker unit including means for storing a plurality of golf balls;
a ball chute;
said ball chute including means for permitting lining up golf balls supplied from said stocker unit;
means for swinging said ball chute between first and second vertical angles;
means ;for discharging one golf ball when said ball chute is at said first vertical angle;
a set arm;
said set arm including a ball-receiving end and a ball-supplying end;
means for moving said set arm between a home position and a tee position; and
agitation means, synchronized with swinging of said ball chute, for giving a back-and-forth shaking to golf balls lined up on said ball chute.

8. The automatic golf-ball supplying device of claim 7, wherein said agitation means includes:
a sliding rail slidably in said ball chute;

a stationary cam;

said stationary cam engaging said sliding rail; and said stationary cam including a shape effective for providing said back-and-forth motion as said ball chute swings between said first and second vertical angles.

9. An automatic golf-ball supplying device comprising:

a stocker unit;

means in said stocker unit for storing a plurality of golf balls;

a ball chute;

means for lining up a plurality of golf balls on said ball chute;

means for swinging said ball chute between first and second vertical positions;

means for discharging one golf ball when said ball chute swings to said first vertical position;

a set arm;

said set arm including a ball-receiving end and a ball-supplying end;

means for horizontally rotating said set arm to position said ball-supplying end between a home position and a teeing position; and a holding means for holding said set arm at said home position and at said teeing position.

10. An automatic golf-ball supplying device comprising:

a stocker unit capable of storing a plurality of golf balls;

a chute unit including means for lining up golf balls from said stocker unit on a ball chute rotatably supported on said chute unit and for discharging golf balls, one ball at a swing of said ball chute;

a set arm including first and second ball delivery positions;

said set arm receiving discharged golf balls from said ball chute;

means, effective when said set arm is in said first ball delivery position, for delivering a ball on a tee; and mat-delivery means, effective when said set arm is in said second ball delivery position, for delivering at least one ball on a mat.

11. The automatic golf-ball supplying device of claim 10, wherein said mat-delivery means includes means for discharging a predetermined number of golf balls, one ball per swing of said ball chute, while said set arm remains stationary at a home position.

12. The automatic golf-ball supplying device of claim 10, further comprising means for selecting said predetermined number of golf balls.

* * * * *